United States Patent [19]

Cooke et al.

[11] 4,169,770

[45] Oct. 2, 1979

[54] ELECTROPLATING ALUMINUM ARTICLES

[75] Inventors: William E. Cooke; John Hodgson, both of Kingston, Canada

[73] Assignee: Alcan Research and Development Limited, Montreal, Quebec, Canada

[21] Appl. No.: 879,465

[22] Filed: Feb. 21, 1978

[51] Int. Cl.[2] ..... C25D 5/44; C25D 7/06

[52] U.S. Cl. ..... 204/28; 204/33; 204/38 B; 204/40; 204/207

[58] Field of Search ..... 204/33, 38 B, 40, 28, 204/206, 207

[56] References Cited

U.S. PATENT DOCUMENTS

| | | | |
|---|---|---|---|
| 3,519,779 | 7/1970 | Dolomont | 204/33 |
| 3,622,470 | 11/1971 | Gowman | 204/33 |
| 3,632,486 | 1/1972 | Herrman | 204/33 |
| 3,915,667 | 10/1975 | Ricks | 204/33 |
| 4,097,342 | 6/1978 | Cooke et al. | 204/28 |

FOREIGN PATENT DOCUMENTS 449162 6/1936 United Kingdom .

OTHER PUBLICATIONS

K. R. Van Horn, Editor; *Aluminum*, vol. III, Fabrication and Finishing; American Society for Metals; 1967; pp. 630–632, 635–640.

B. A. Shenoi et al., "Electropolishing Aluminum"; *Metal Finishing*, Dec. 1963; pp. 50–54.

Wernick and Pinner; *Surface Treatment of Aluminum*, 4th Edition, Robert Draper, Ltd., Teddington (England) 1972, pp. 455–457.

Wernick and Pinner; *Surface Treatment of Aluminum*, Robert Draper Ltd., Teddington (England) 1956; pp. 155–156.

Metal Finishing Guidebook and Directory for 1975; Nathaniel Hall, Editor, Metals and Plastics Publications, Inc.; Hackensack, N.J., pp. 116–118, 681.

Electroplating Engineering Handbook; Kenneth Graham, Editor, Reinhold Publishing Corp.; New York, 1962, pp. 161–163.

*Primary Examiner*—John H. Mack
*Assistant Examiner*—William Leader
*Attorney, Agent, or Firm*—Cooper, Dunham, Clark, Griffin & Moran

[57] ABSTRACT

In a process for electroplating aluminum articles, the article is first electrolytically treated, as anode, in a bath consisting essentially of a solution of caustic alkali, and thereafter electroplated. The electrolytic caustic cleaning step, preferably involving agitation, is found specially suitable in composition and indeed is effective in a relatively short time to afford an essentially bare aluminum surface, i.e., free of anodic oxide film and also free of pitting or smut, for advantage in plating, as with tin or other metal. Intermediate steps can be employed such as immersion tinning or zincating and brief electroplating such as a bronze strike; the electrolytic cleaning co-acts well with the intermediate stages, indeed requiring fewer steps over all. Although applicable batchwise, the process is particularly appropriate for continuous electroplating wherein the aluminum wire or strip may pass rapidly through the electrolytic cleaning, intermediate and plating baths in succession.

21 Claims, 3 Drawing Figures

ELECTROPLATING ALUMINUM ARTICLES

BACKGROUND OF THE INVENTION

This invention relates to electroplating aluminum articles and is of particular advantage in electroplating aluminum stock such as strip, rod or wire.

The purposes of electroplating aluminum surfaces vary in a manner generally corresponding to the production of other plated metals, but are often related to the advantages, such as light weight, electrical conductivity of the underlying aluminum, and the desirability of having a finish of a different metal, e.g., for appearance or hardness or corrosion resistance, or the like. One particular reason for electroplating aluminum stock, such as wire or other conductors, is to obviate the electrical contact resistance normally due to oxide. Electroplating with tin, for example, can avoid the formation of a high-resistance, surface film of aluminum oxide which impairs achievement of best electrical conduction to another metal object in contact with the aluminum articles. As will be understood, electroplating of other aluminum articles may be advantageous where a hard, bright, non-corrosive finish is desired, yet lightness of weight is important, as for designing exterior parts of vehicles to save energy by reducing weight.

One known technique for plating aluminum, for instance with tin, has involved the successive steps of degreasing, etching, de-smutting, and then steps such as immersion tinning, a bronze strike, possibly a step of acid conditioning, and finally the actual tin plating itself. The bronze strike and the final tin plating are the only electrolytic steps. Similar steps are used for plating aluminum stock with other metals.

More specifically, one procedure has involved not only a degreasing, but an etching in caustic solution, i.e., a step of purely chemical treatment, followed by a rinse, then an acid dip to remove so-called smut from the surface and thereafter another rinse, before the usual pre-plating treatment of treatments, such as a zincate or stannate immersion. The objectionable features of this technique are that the chemical caustic for cleaning tends to roughen the surface and thereby impair its usefulness when ultimately plated, especially for a bright trim product (e.g., chromium-plated), or the like. The chemical treatment also leaves a smut on the surface which is objectionable for subsequent plating adherence. Hence, a special acid dip is employed to remove the smut. Furthermore, the rinses necessary for both the caustic chemical treatment and the acid de-smutting treatment add complexity to the series, requiring time and equipment, create loss by chemical dragout and cause further disposal problems for the effluents from the system.

In a related patent application of Cooke, Hodgson and Sasaki, for Electroplating Aluminun Stock, Ser. No. 578,324, filed May 16, 1975, now abandoned a procedure for electrolytic cleaning of aluminum stock prior to electroplating is described. The specific cleaning step disclosed and claimed, and the examples of it, involve an acid elctrolytic treatment, particularly utilizing a mixture of concentrated acids, e.g., mixtures of phosphoric acid with sulfuric or nitric acid, or a mixture of sulfuric and chromic acids, at relatively high temperatures. These operations, wherein the metal is anodic, have been found effective in producing a clean, smooth surface, without smut and with an avoidance of oxide film that would be troublesome for electroplating of electrical conductors. The cited application also mentions the possible alternative of an electrolytic alkaline cleaning, but no specific treatment of special value was disclosed, nor any example thereof, nor was any actual chemical solution for such purpose described or named.

SUMMARY OF THE INVENTION

It has now been found that unusual advantages and convenience are achieved, for a procedure of electroplating aluminum surfaces, by employing an electrolytic caustic cleaning treatment, i.e., with sodium or potassium hydroxide, at the outset of the method, particularly an electrolytic treatment with the aluminum as anode. Specific characteristics of chemical content and specific features of time, temperature, concentration and voltage are requisite, and indeed, it has been found that unexpectedly low voltages may be employed and other unanticipated results achieved, for the sake of economy and operating convenience. In particular, this process enables cleaning to be effectuated in a single, electrolytic, caustic alkaline stage wherein the stock or work is made anodic, and several other operations heretofore regarded as necessary are omitted.

Thus, this electrolytic step may replace the previous etching or cleaning step of purely chemical nature, as well as the preceding degreasing stage in most cases. Furthermore, if the complete sequence for plating involves an alkali zincate or stannate immersion treatment, there need be no rinse between the electrolytic caustic step and such immersion stage. In contrast, after chemical alkaline treatment a rinse was necessary in order to prepare the metal surface for the required acid de-smutting stage. Then, after the latter stage another rinse was needed because the succeeding zincate or stannate immersion is alkaline, not acid. Hence, the two rinses and the intermediate acid treatment represented three sucessive operations, each adding complexity and expense to the process. The rinses, moreover, involved loss of valuable chemicals, first alkali and then acid, because of drag-out from the immediately preceding steps.

All of these three steps, i.e., rinses and acid de-smutting, can be omitted in the present process, thus obviating the expense of such steps, and the waste involved in the chemical drag-out into the rinses. With the caustic electrolytic treatment for cleaning, no smut is formed, and hence no acid treatment is needed, nor a rinse to remove the acid. Moreover, it is found that because the electrolytic cleaning is alkaline, it is feasible to carry the work directly to the alkali zincate or stannate, avoiding the first rinse and indeed usefully recovering the alkaline drag-out in the zincate or stannate baths. In other words, a very considerable simplification of the process is achieved, avoiding three steps, and saving valuable chemicals otherwise lost in the drag-outs.

Another advantage of the electrolytic caustic cleaning, is that whereas chemical alkaline treatment tends to leave the aluminum surface etched or pitted, i.e., roughened in a manner less than desirable for a good, bright, plated surface, the electrolytic caustic step, at a pH of 11 or very preferably higher, not only cleans very effectively (and essentially removes the oxide film), but can yield a very smooth surface, highly satisfactory for plating.

Indeed, the present process is believed to involve marked improvement in comparison with the electrolytic acid treatment of the above-identified co-pending application, Ser. No. 578,324, wherein the present, specific invention using caustic was not disclosed and wherein it was not appreciated that any alkaline electrolytic step would be of greatly significant value, as distinguished from prior non-electrolytic procedures or from the particular procedure of that application relating to electrolytic cleaning with the stated, mixed acids. Not only is the cleaning operation of the present process excellent, with the same avoidance of smut as in acid treatments, but unusual economies and advantages are found to occur. Most notably, the chemical cost (caustic instead of mineral acids) is basically less for the same effectiveness, and there is substantial further saving, in fewer steps and in avoidance of waste. The voltage required for the electrolytic caustic cleaning, very conveniently a drop of only 1 to 2 volts, is much lower than for an electrolytic acid step, affording an unexpected saving in energy and expense, and further advantage in less generation of heat.

In an important specific aspect, this invention is related to continuous operation wherein a continuing piece of aluminum to be plated traverses first an electrolytic cleaning bath and then succeeding solutions terminating with the electroplating bath, while electrical function is achieved by passing current from an anode (of the selected plating metal) to the aluminum stock as cathode in the last bath, for plating, and then passing the current from the stock (as anode) to a cathode in the first, i.e., alkaline, cleaning bath. With utilization of this electrical current scheme, utilizing a liquid contact principle employed in other continuous electrolytic operations, mechanical contact (e.g., sliding or rolling contact) with the moving work or stock is not required for electrical connection to it, and there is corresponding simplification and convenience of procedure. The continuous operation is of special advantage for treating electrical conductor, such as wire, strip or other elongated elements that can run continuously through the required baths so as to yield a product effectively plated, for example, with tin.

In a more generic sense, the present process has been found applicable to batch-type operation, as upon articles for which continuous treatment is not required or suitable. Distinct economies as to chemical cost, avoidance of drag-out loss, simplicity in number of steps are attainable, with unusually effective cleaning to produce a smooth, essentially oxide-free surface for the subsequent electroplating.

DETAILED DESCRIPTION

As explained above, the invention embraces a process of electroplating aluminum wherein the aluminum surface is first elecrolytically cleaned by passing electric current from the aluminum as anode to a suitable cathode through an aqueous solution of caustic alkali under specific conditions of concentration, time, temperature, voltage and current density, as hereinbelow described (and with appropriate agitation, e.g., of the bath), whereby a clean, smooth, essentially oxide-free surface is produced, and thereafter subjecting the aluminum surface to electroplating, with tin or other metal, by passing current from a suitable anode, e.g., of the plating metal, to the aluminum as cathode from a bath appropriate from such plating, preferably with agitation, e.g., of the work. A specific requirement is that the electrolytic cleaning bath consist essentially of a solution of caustic, meaning caustic alkali; that is to say, the solute in the bath consists essentially of sodium hydroxide or potassium hydroxide or a mixture of them.

The process, as explained above, has special advantages where the aluminum, after the electrolytic caustic cleaning, is first subjected to a non-electrolytic stannate or zincate treatment, i.e., by dip in a solution reacting chemically to deposit tin or zinc on the aluminum surface; indeed, the procedure of the invention is a presently preferred, specific sense may include such step for its usual purposes, with the new result that no intermediate steps, even of washing, are required between the cleaning and the tin or zinc deposition. Moreover, the process is further compatible with the use of a preliminary, brief electroplating step or strike, such as a bronze strike, on the aluminum as cathode, between the stannate or zincate step and the principal electroplating operation wherein the aluminum is likewise cathodic.

Figure 1:
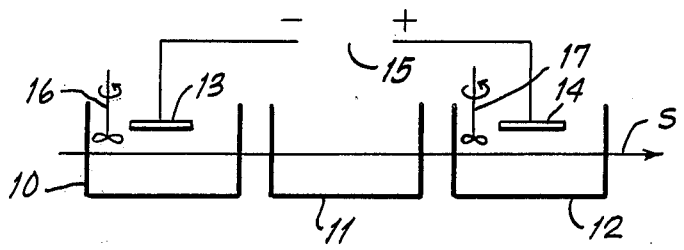
FIGS. 1 and 2 show schematically two examples of apparatus for performing the continuous process of the invention.

To illustrate the described specific invention in continuous operation for plating aluminum wire, rod, strip or the like, FIG. 1 shows one example wherein the liquid contact principle is simply applied in the performance of successive electrolytic operations. There are three baths, each containing an appropriate solution, and the aluminum stock S moves through them in the direction of the arrow. In the first (leftmost) bath 10, the electrolytic cleaning of the stock in caustic solution at elevated temperature takes place; in the second bath 11, the stock is treated non-electrolytically with a conditioner, e.g., a stannate or zincate dip, while metal plating is carried out in the third bath 12. The conditioning bath 11 may be replaced by other baths of like or different purposes as requisite in some cases, or may even be omitted in plating certain metals from baths which are compatible with bare aluminum, e.g., direct plating. Zinc can be plated on aluminum in this way.

In the first and third baths are respective electrodes 13 and 14, respectively connected to the negative and positive terminals of a current source 15. In use, current from the source passes from electrode 14, the anode (usually composed of the metal which is to be plated on the aluminum), through the solution to the aluminum stock in the electroplating bath 12 which is therefore the cathode. The current then passes through the stock to the electrolytic caustic cleaning bath 10, leaves the stock and travels to electrode 13 and thence to the source. In bath 10, the aluminum stock is anodic and the electrode cathodic. The electrode 13 may be of graphite or stainless steel.

Alkali which may be such as is elsewhere herein described is contained in bath 10 and plating solution is in bath 12. The zincate or stannate solution or other conditioner 11 will be selected according to the plating taking place. Although the use of only one immersion step between cleaning and plating is a feature of special advantage, it is apparent that in general more than one conditioning step can be used, although this may increase the stock length carrying the current. Agitation is essential or important in the caustic cleaning and main electroplating operations 10 and 12, as here simply indicated by elements 16 and 17, respectively.

Figure 2:
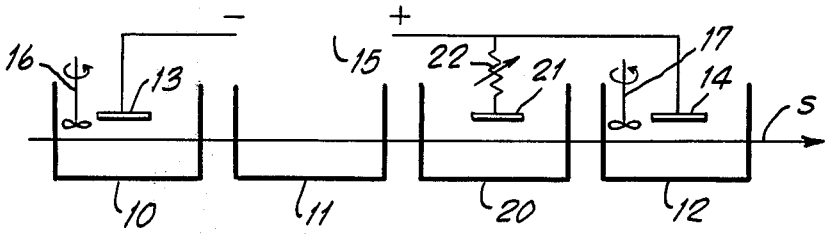

FIG. 2 shows the application of the liquid contact principle with an additional electroplating step. Like parts are given like reference numerals, when compared with FIG. 1, and it will be seen that the only difference from FIG. 1 is the provision of a preliminary plating bath 20, and a corresponding additional electrode 21 connected to the positive terminal of the current source through the variable resistor 22.

An arrangement of this type would be used when performing the preferred method of the invention involving caustic electrolytic cleaning (in bath 10), zincating or tinning (in bath 11), bronze strike (in bath 20) and metal, particularly tin, plating (in bath 12).

As shown in the drawing, the method of the invention can thus be performed during continuous processing, in which the bath liquids themselves are employed as electric contacts. Thus, anodes in the metal plating bath or baths and cathodes in the caustic electrolytic cleaning treatment stage are connected to opposite poles of the D.C. supply. This removes the need to use sliding or rolling contacts between the aluminum and an electrical supply. Despite some proposals to use liquid contacts in pickling and plating steel, sliding or rolling contacts have continued in general use, being a source of difficulty in continuous plating operations and leading to severe maintenance problems due to build-up of corrosion products and oxides on the contacts which result in arcing and pitting of both contact and stock.

The process of the invention is applicable to the plating of aluminum with a variety of metals, including tin, and there is particularly provided by the present invention a method of metal plating aluminum stock (e.g., wire, rod or strip) including the steps of electrolytically cleaning the stock under anodic conditions in caustic at elevated temperature, immersion tinning or zincating the stock, an electrolytic bronze strike (i.e., electrolytic deposition of very thin coating of copper-tin alloy) and electrolytic metal plating. These steps are particularly suitable when tin is the plating metal, but can also be used when, for instance, aluminum is to be plated with brass, zinc, lead, nickel or copper. Preferably, as shown in FIG. 2, the above-described liquid contact principle is used in the cleaning, bronze strike and metal plating steps, in which case the electrodes in the bronze strike and metal plating baths are connected to the positive terminal of the current source and an electrode in the caustic bath to the negative terminal of the source.

In the specific circumstances of the described continuous operation, the voltage drop across the caustic cleaning bath which the stock first traverses, should be within a range of 0.8–15 volts, or preferably 0.8–10 volts, or very preferably 0.8–2.5 volts, e.g., not more than about 2 volts, in the sense of avoiding any reason for so-called dwell time (by a longer passage distance in the bath) following application of current, i.e., after the stock passes the cathode 13. In general, the concentration of caustic, considered as sodium hydroxide, may be in the general range of 25–250 gpl (grams per liter), or 0.625 to 6.25 mol., with pH above 11, but convenience is best served by solutions in the range of 50–150 gpl, being 1.25 to 3.75 mol. Where potassium hydroxide is used as whole or part replacement for sodium hyroxide, amounts are used so that the total caustic content is the molar equivalent of NaOH; thus KOH can be used alone in concentrations by weight about 40% greater than NaOH. Although there is some advantage of operating the bath quite hot, say upwards of 60° C., in permitting voltages at the lower range of values given above, successful results have been achieved in operations anywhere in the wide range of 40° C. and higher, for instance in the range of 40°–85° C.

With the voltages in the range of values stated, current densities are satisfactorily attained in the cleaning cell 10 in the range of 500–1000 amperes per square foot or, more generally, 200–1500 amperes per square foot. As will now be appreciated, the time of treatment may vary and is interrelated with the current density and the length of the path through the electrolyte traversed by the moving stock. In a cell 3.6 meters long, having a cathode 13 almost that long, the work was satisfactorily treated with a residence time of 5 or 6 seconds. Thus, it would appear that assuming no after-treatment dwell is needed, a path length of 1 to 10 meters travel of the work along the cathode 13, and a stock speed selected to afford a residence time of 2 to 20 seconds, represent examples of ranges expected to be notably successful for the continuous process.

In one example of operation, the method was tested for continuous electroplating of 0.081 inch diameter EC wire (i.e., aluminum wire, electrical conductor grade) with tin, using equipment such as shown in FIG. 2. With specific conditions as now described, a throughput speed of about 120 feet per minute, or about 36 meters per minute, was obtainable in conjunction with bath lengths at stages 10, 11, 20 and 12 of 3.6, 0.9, 0.9 and 3 meters, respectively. The electrolytic cleaning bath 10 consisted of an aqueous solution of sodium hydroxide, at a concentration of 50 gpl, a pH of about 13, and a temperature of 60° C. A total of 21 volts at the source 15 was required to provide 230 amperes to the system, which was, of course, the current through the wire stock S between bath 20 (with bath 12) and bath 10 and also through bath 10 to the electrode 13, thus representing a current density of about 1000 amperes per square foot in the electrolytic cleaning operation. The voltage across the cleaning cell 10 was about 2 volts, the remaining drop occurring across the plating cells 20 and 12. A sound, adherent tin layer of 3 mircons thickness resulted.

Instances of compositions employed for the baths 11, 20 and 12 are now given. Thus, with zincating performed at the second step 11, an aqueous bath composition as follows may be used:

40 gpl $ZnSO_4.7H_2O$
106 gpl NaOH
40 gpl $KHC_4H_4O_6$ to which may be added 10 gpl KCN.

A residence time of 2 seconds with the bath at 40° C. is found to be satisfactory.

In the specific test example above, tinning was actually selected as the second step, and an aqueous bath composition as follows was used:

50 gpl $K_2SnO_2.3H_2O$
1.5 gpl $H_3BO_3$

A residence time of 2 seconds is suitable with the bath at 45° C.

For the third step, the bronze strike, a suitable aqueous bath solution is as follows:

140 gpl $K_2SnO_3.3H_2O$
36.5 gpl CuCN
75.5 gpl KCN
7.5 gpl KOH

A temperature of 40° C., a residence time of 2 to 3 seconds and a current density of 20 to 35 $A/dm^2$ provide satisfactory conditions for aluminum stock.

An alternative bath solution was in fact employed for the bronze strike in the above test; such solution is obtainable from M & T Chemicals, Inc. and comprises Alstan 71 (a powder of which 180 gpl may be used) plus Alstan 72 (a concentrate of which 50 ml/l may be used). This may be employed satisfactorily at 40° C. with a residence time of 2 seconds and a current density of 30 $A/dm^2$.

The metal plating bath, where the metal is tin, may be as follows:

300 gpl $Sn(BF_4)_2$
200 gpl $HBF_4$
25 gpl $H_3BO_3$
30 gpl gelatin
1 gpl β-naphthol Alternatively, $H_3BO_3$ and gelatin may be omitted and $HBF_4$ content reduced to 50 gpl. In both cases, a temperature of 35° C., residence time of 5 seconds and current density of 100 to 120 $A/dm^2$ (900 to 1100 amperes/sq. ft.) are preferably employed where a tin coating of 3 to 5 mircons is plated.

In the above operations, and indeed in preferred practice of the invention, strong agitation is employed in the electrolytic cleaning operation. It is indicated that with a desirably low voltage of applied potential, the anodic current density is unsuitably low with quiescent conditions, but rises to satisfactory values with vigorous agitation of the bath.

It is also very desirable, in most cases, to provide vigorous agitation in the metal plating baths, notably the principal plating bath 12. Thus, with current densities of a value of 600 amperes per square foot and above, as desired in the plating bath for rapid, continuous operation, the process is much more efficient if the aluminum stock or the electrolytic solution is agitated, especially in the case of tin plating. Thus, the stock may be agitated by passing it through a ring located centrally of the plating bath, and oscillating the ring.

Figure 3:
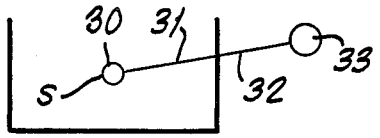
FIG. 3 shows one form of apparatus for oscillating the aluminum stock in the metal plating bath.

FIG. 3 shows schematically one method of such agitation of the aluminum stock in the plating bath. The stock S passes through the ring 30, suitably of polytetrafluoroethylene, on one end of an arm 31 pivoted in the bath wall at 32. The other end of the arm is eccentrically mounted on a disc 33 on the shaft of a drive means such as an electric motor (not shown). The ring 30 is disposed suitably half-way along the plating bath, and it has been found that vibrations of amplitude about 10–15 mm at 10 c/s frequency increase greatly the current density which can be used in the plating bath. If the wire is not vibrated in this way, or if the solution in the bath is not otherwise agitated, then a longer plating time provided by a longer bath or lower stock speed would be required.

More generally stated, the agitation can be effected by oscillating the ring at 2–30 c/s, more preferably 5–15 c/s. The amplitude of oscillation any range from 1.5 to 75 mm, but most usually in the range 5–25 mm. Agitation of the electrolyte apparently brings the metal surface into contact with fresh electrolyte, thus continuously replacing the metal ions next to the metal surface. The agitation of the bath is also effective in reducing "treeing" of deposited tin.

Study of the relationships among concentration of caustic, current density and temperature in the electrolytic cleaning bath, and likewise comparison of such baths with electrolytic acid cleaning as embraced in the aforesaid copending application, Ser. No. 578,324, has indicated that voltage requirements are unexpectedly low and are reduced with increasing concentration of caustic, and also greatly with increasing temperature, in considering treatments of very short duration, such as are useful in continuous processes.

Thus, the following table, relating to tests of a 5-second treatment (thus simulating a continuous treatment) shows the relation of temperature to voltage requirement. This is given for a 50 gpl caustic solution and also for an acid solution of phosphoric and sulfuric acids, as noted:

TABLE 1

Voltage Requirements For Anodic Electrolytic Cleaning At 1000 A/Sq. Ft. In Caustic And Acid Electrolytes, Time Of 5 Sec.

| Temp. (°C.) | 50 gpl NaOH | 37% 18% $H_3PO_4$-$H_2SO_4$ |
|---|---|---|
| 40 | 12.5 | |
| 45 | 10 | |
| 50 | 7 | |
| 55 | 4 | |
| 65 | 2.5 | 16.5 |
| 70 | 2.5 | 15.0 |
| 75 | 2.0 | 13.5 |
| 80 | 2.0 | 12.5 |
| 85 | 1.5 | 10.0 |

As will be seen, the caustic solution permits the use of much lower voltages than the acid solution. This is of great advantage in reducing energy requirements, avoiding excessive heating and avoiding undue attack on the aluminum.

The following additional table, also representative of test results with treatments of 5-second duration, shows not only the relation of temperature to voltage but also the substantial further reduction of voltage that is achieved with higher concentrations of sodium hydroxide. It will be noted that the following table relates to a somewhat lower current density than Table 1:

TABLE 2

Voltage Requirements For Anodic Electrolytic Cleaning At 660 A/Sq. Ft. In Caustic Electrolytes, Time Of 5 Sec.

| Temp. (°C.) | 50 gpl NaOH | 100 gpl NaOH |
|---|---|---|
| 40 | 7.5 | 4.5 |
| 45 | 4.5 | 2.5 |
| 50 | 3.0 | |
| 55 | 2.5 | |
| 60 | 2.0 | 1.0 |
| 65 | 2.0 | 1.0 |
| 70 | 1.5 | 0.5 |
| 75 | 1.0 | 0.5 |

As indicated above, the lower voltage requirements are generally preferred, for the reasons stated, and it appears that best results are obtainable with a voltage drop of about 1–2 volts. Where the potential difference is substantially less, for example as in the two conditions of 0.5 volt in Table 2, the results are poor, yielding a tendency to smut formation, and providing relatively poor adhesion of the ultimate electroplating. Subject to this minimum, the lower voltages are desirable in respect to both lower costs and less heat generation.

It has been noted that in order to assure an aluminum surface essentially free of aluminum oxide, a post-anodic dwell period is required where the applied voltage is greater than about 2 volts. This means that in continuous operation the work piece or stock travels beyond the immediate electrode area, within a further extent of the caustic bath, before transfer to the next stage. In a batch operation, a corresponding dwell period is achieved by turning off the current for such interval after the anodic electrical step. This dwell or remainder time should not be unduly long, because oxide-free metal may become dissolved, leaving a smutted and perhaps even pitted or etched surface. The dwell time serves to remove the last traces of oxide and is required to be greater with greater voltages. For example, in Table 1 at the 45°, 10 volt treatment in 50 gpl NaOH, a dwell of about 3 seconds would be optimum. For the 40°, 12.5 volt condition, a dwell time of about 5 seconds would be suitable, and at 65°, with 2.5 volts, the necessary dwell time would be relatively inconsequential, e.g., at most about 1 second.

Tables 1 and 2 in effect represent examples of the caustic electrolytic treatment, including demonstration of certain advantages over the electrolytic acid treatment, it being understood that essentially all of the exemplified conditions for the caustic solutions provide satisfactory precleaning, with dwell time of appropriate nature in required cases as explained above. The exceptions are the two conditions at 0.5 volt in the 100 gpl NaOH column in Table 2; these would not provide very satisfactory cleaning procedures, for reasons explained above. In all examples, pH was about 13.

As will now be apparent, in the continuous process, the total number of steps is relatively small, being generally no more than 4, including a non-electrolytic immersion tinning or zincating step after the cleaning stage and also a bronze strike prior to the main plating, these steps being desired in at least many cases for best preparation of the aluminum surface. In the preferred process, as in FIG. 2, it is generally found that up to about 10% of the total current entering the aluminum stock would do so in the bronze strike bath 20, the remainder in the metal plating bath 12. The voltages for these operations are usually similar, so that a single current source can be used for both, although spearate sources can be employed if desired. A convenient arrangement is the resistor 22, to adjust the bronze strike voltage from equality with the plating voltage to various lower values, for corresponding latitude in current control. The thickness of the metal deposits, especially the plating coating, can be varied in a conventional manner, as by altering the speed or, within limits, the current.

As will be noted, the times of treatment, in the various baths of the continuous process, are advantageously very short, being less than a minute in each case, indeed very preferably less than half a minute, or with particularly satisfactory results, confined to times not more than about 20 seconds, i.e., in each bath. Although it has been found that carbonate or phosphate additions, i.e., of the alkali metals, may be made to the caustic solutions as in very small quantities for dispersing grease or other special purpose, e.g., about 1% trisodium phosphate or up to 2% sodium carbonate, no major advantage has been noted. The essential characteristic of the electrolytic cleaning bath, however, is that it be a solution of caustic, being potassium or sodium hydroxide, or both. Tests have also been made with other additions, such as sodium gluconate, known as a substance for complexing aluminum in alkaline solutions. An addition of gluconate (e.g., 30 gpl) would serve to stabilize the caustic solution, thus increasing the lift of the bath. In no event should any addition be such, in proportion or otherwise, as to reduce the pH below 11. As will be understood, a major object of the caustic electrolytic cleaning is to provide a surface that is free of aluminum oxide film, i.e., a bare aluminum surface. In the specific sequence of steps, this result is achieved and there is not even any need for intermediate washing in most cases. Following the precepts given above, excellent adherence of the ultimate plating on the aluminum, whether of tin or other metal, is achieved.

In a more general sense, the process is applicable to batch-type operation, as for articles to which continuous treatment is not required or suitable. In such case, while the above values of concentration, current density and the like may be employed, there is no need to match the high speeds and high-current values required for rapid plating, and in consequence, the current densities may range down to 20 or even 10 amperes per square foot (preferably 25–35) and the electrolyte concentrations may range down to 1 or 2 grams per liter of caustic soda, e.g., up to the higher values mentioned above. Nonetheless, it is critical that the pH of the caustic electrolyte solution be at least 11 or preferably well above, e.g., 12 or 13, as distinguished from electrolytes used for previous anodic treatments, whether for film-forming or for polishing (with unavoidable film development), that are primarily sodium carbonate, phosphate, borate or glycollate and usually have a pH of around 10. In the present process, moreover, the voltage across the cleaning bath is low, e.g., well below 10, and the treatment time is short, usually requiring less than 10 minutes even for batch operation.

By way of example, in a batch process a typical current density for the pretreatment by electrolytic caustic operation is about 25 amperes per square foot, this being in significant contrast to the normally desired, much higher current densities for continuous processing.

As will be understood, suitable results from electrolytic caustic cleaning at low current density require either a relatively dilute bath or a relatively moderate temperature, or both. Under circumstances that can be taken as representative, the relation between temperature and voltage in a low current density operation (batch treatment) was determined by tests, reported in the following table:

TABLE 3

Voltage Requirements For Anodic Electrolytic Cleaning At 27 A/Sq. Ft. In 2 GPL NaOH Electrolyte

| Temp. (°C.) | Voltage |
|---|---|
| 30 | 2 |
| 40 | 2 |
| 50 | 1.4 |
| 60 | 1.0 |
| 70 | 0.8 |
| 80 | 0.6 |

The treatments in the table were effected for a period of 2 minutes, in contrast to the very short treatments used in continuous operation. Excellent adhesion of a subsequent deposit of tin was attained on the aluminum specimens (of Table 3) treated at 30°–50° C., while a slight loss of adhesion was noted on those treated at 60° and 70°. Poor adhesion of the later tin plating was obtained on the 80° specimen. These results confirm the earlier findings of this invention, namely, that a potential difference of at least 0.8 volt or preferably about 1 to 2 volts appears requisite for good adhesion.

As also indicated above, strong agitation of the caustic electrolytic bath was found necessary. In relation to these low-concentration, low-current density baths, a stagnant bath at 25° C. containing 1 gpl NaOH yielded an anodic current density of only 3 amperes per square foot, with 2 volts applied potential, and only 5 amperes per square foot, with 10 volts applied potential. The same bath strongly agitated, however, yielded a current density of about 20 amperes per square foot with applied potential of 2 volts.

It will be understood that the batch type treatment, suitable for articles that cannot be handled continuously and require electroplating on their aluminum surfaces, e.g., any of the metals mentioned above or others, such as cadmium, chromium, or the like, affords significant advantages of economy and effectiveness. As will be understood, the subsequent treatments, such as an immersion plating step, if desired, likewise a bronze strike or equivalent when needed, and finally the actual electroplating itself, may be achieved with compositions and conditions similar to those given above for the continuous process, or more generally, with compositions and conditions appropriate and well known for batch type plating.

While water washing or like steps may be interposed between various successive stages of the process in either continuous or batch operation, an important preferred feature is that, with one exception, all of same may be omitted, especially in that the bare aluminum delivered from the electrolytic caustic cleaning bath can be immediately transferred (without any intermediate washings or de-smutting) to the zincate or stannate dip. The exception mentioned above is that rinsing is required between the last alkaline bath in the process and an acidic electroplating bath. In continuous operation utilizing liquid contact, this feature minimizes the length of aluminum required to carry current, so that heating and possible strip or wire breaking difficulties are reduced. All solutions described hereinabove were, of course, aqueous solutions.

It may be explained that the electrolytic caustic cleaning step of the present process is basically not a brightening or polishing operation, and that prior electrolytic alkaline operations for the latter purpose would not be suitable for this invention. In polishing (or brightening) the operation cannot in practice be such that the anodic oxide film on the aluminum surface is removed as fast as or faster than it is formed, because an electrolyte sufficiently aggressive for such results causes pitting of the surface over the length of treatment required to remove sufficient metal for the polishing action. Hence sodium or potassium hydroxide solutions would be unsuitable for electropolishing because they have, so to speak, poor surface-leveling ability; in consequence, alkaline solutions for electropolishing, e.g., being essentially carbonate, phosphate or the like, are usually characterized by a pH of not more than about 10. Since polishing requires significant metal removal, such operation needs relatively long treatment times. This action is effective to achieve a well-polished surface; because of the less aggressive electrolyte, pitting is avoided, but for the same reason, an oxide film is invariably produced. In the present cleaning process, efficiency is achieved by using aggressive, high-pH solutions of caustic, with relatively short treatment times or low voltages appropriate for excellent cleaning, yet without pitting. At the same time, unlike the polishing treatments mentioned above, the cleaning step avoids or minimizes any oxide film, and such as may occur to a slight extent in some cases can be rapidly removed by the brief post-treatment dwell which has been described. In this way a truly bare metal surface is very easily achieved, for the subsequent plating operation.

It is to be understood that the invention is not limited to the specific features described by way of example but may be carried out in other ways without departing from its spirit.

We claim:

1. A process for the production of metal-plated, elongated aluminum stock which comprises passing the aluminum stock continuously (1) during less than a minute through a caustic electrolytic cleaning bath having a pH of at least 11 and containing an electrolyte having a high dissolving power for aluminum oxide and consisting essentially of a solution of caustic selected from a group consisting of sodium hydroxide and potassium hydroxide, while effecting agitation of one of the article and bath relative to the other; and subsequently (2) through an electroplating bath containing a metal plating electrolyte, the first-mentioned bath having a cathode electrode immersed therein and the second-mentioned bath having an anode electrode immersed therein whereby to render the stock anodic in the first bath and cathodic in the second bath; the composition and temperature of the solution in the first bath, and the voltage across said bath of at least 0.8 volt, being effective to clean the aluminum by the electrolytic treatment and the passage of the aluminum through the first bath, including the electrolytic treatment, being sufficient to deliver the aluminum essentially free of oxide on its surface.

2. A process as defined in claim 1, in which the aluminum stock is passed through a non-electrolytic chemical immersion bath for applying metal to the aluminum surface, between the cleaning bath and the aforesaid electroplating bath, said immersion bath being selected from the class consisting of zincate and stannate baths, and said stock being passed directly from the cleaning bath to said immersion bath without intermediate liquid treatment.

3. A process as defined in claim 2 in which the concentration of caustic in the cleaning solution is about 0.625 to 6.25 mol.

4. A process as defined in claim 1 wherein electric current, from a supply, for electrolytic cleaning in the first bath and for plating the stock with metal in the second bath is passed from said anode successively through the second bath, the stock and the first bath, to the cathode.

5. A process as defined in claim 4 in which said stock passes through a bronze strike bath intermediate the cleaning bath and said electroplating bath, said bronze strike bath containing an anode in an electrical circuit in parallel with the circuit of the plating bath, electric current being passed from the anode of said bronze strike bath through said strike bath to the stock in said strike bath circuit in parallel with the current through the plating bath circuit, and the total current from said plating and strike bath circuits being passed from the stock through the electrolytic cleaning bath to the cathode.

6. A process as defined in claim 5 in which the aluminum stock is passed through a non-electrolytic chemical immersion bath for applying metal to the aluminum surface, between the cleaning bath and the bronze strike bath, said immersion bath being selected from the class consisting of zincate and stannate baths, and said stock being passed directly from the cleaning bath to said immersion bath without intermediate liquid treatment.

7. A process according to claim 6 in which the concentration of caustic in the cleaning solution is about 0.625 to 6.25 mol.

8. A process according to claim 7, which is for production of tin-plated aluminum stock and in which the electroplating bath contains a tin-plating electrolyte.

9. A process according to claim 1, which is for production of tin-plated aluminum stock and in which the electroplating bath contains a tin-plating electrolyte.

10. A process as defined in claim 1 in which the concentration of caustic in the cleaning solution is about 0.625 to 6.25 mol, and in which the voltage across the cleaning bath is 0.8 to 15 volts.

11. A process as defined in claim 10 in which the caustic solution of the cleaning bath is sodium hydroxide solution and the voltage across said bath is 0.8 to 2.5 volts.

12. A process as defined in claim 10 in which the current density through the first bath at the stock is in the range of 200 to 1500 amperes per square foot.

13. A process as defined in claim 12 in which the concentration of caustic in the cleaning solution is 1.25 to 3.75 mol.

14. A process for the production of a metal-plated aluminum article which comprises treating the aluminum article (1) in a caustic electrolytic cleaning bath having a pH of at least 11 and containing an electrolyte having a high dissolving power for aluminum oxide and consisting essentially of a solution of caustic selected from the group consisting of sodium hydroxide and potassium hydroxide, while effecting agitation of one of the article and bath relative to the other; and subsequently (2) in an electroplating bath containing a metal-plating electrolyte, the first-mentioned bath having a cathode electrode immersed therein and the second-mentioned bath having an anode electrode immersed therein whereby to render the article anodic in the first bath and cathodic in the second bath; the composition and temperature of the solution of the first bath, and the voltage across said bath of at least 0.8 volt, being effective to clean the aluminum by the electrolytic treatment, and the treatment of the aluminum in the first bath, including the electrolytic action, being sufficient to deliver the aluminum essentially free of oxide on its surface.

15. A process as defined in claim 14 in which the caustic solution is sodium hydroxide solution.

16. A process as defined in claim 14 in which the pH of the cleaning bath is about 13.

17. A process for the production of a metal-plated aluminum article which comprises treating the aluminum article (1) in a caustic electrolytic cleaning bath having a pH of at least 11 and containing an electrolyte having a high dissolving power for aluminum oxide and consisting essentially of a solution of caustic selected from the group consisting of sodium hydroxide and potassium hydroxide, while effecting strong agitation of one of the article, and the bath, relative to the other; and subsequently (2) in an electroplating bath containing a metal-plating electrolyte, the first-mentioned bath having a cathode immersed therein and the second-mentioned bath having an anode immersed therein whereby to render the article anodic in the first bath and cathodic in the second bath; the composition and temperature of the solution of the first bath, and the voltage across said bath of 0.8 to 15 volts and the current density of at least about 10 amperes per square foot at the article, being effective to clean the aluminum by the electrolytic treatment, and the time and aforesaid nature of treatment of the aluminum in the first bath, including the electrolytic action, being suitable to deliver the aluminum essentially free of oxide and pitting on its surface.

18. A process according to claim 17 in which the aluminum article is treated in a non-electrolytic chemical immersion bath for applying metal to the aluminum surface, between the cleaning bath and the aforesaid electroplating bath, said immersion bath being selected from the class consisting of zincate and stannate baths, and said article being taken directly from the cleaning bath to said immersion bath without intermediate liquid treatment.

19. A process according to claim 18 which is for production of a tin-plated aluminum article and in which the electroplating bath contains a tin-plating electrolyte.

20. A process according to claim 18 in which the caustic solution of the cleaning bath is sodium hydroxide solution and the voltage across said bath is 0.8 to 2.5 volts, such current density value being at least 20.

21. A process according to claim 17 in which the aluminum article is treated in a bronze strike bath intermediate the cleaning bath and said electroplating bath, said bronze strike bath having an anode therein whereby electric current is passed through said strike bath to the article.

* * * * *